US008092407B2

(12) United States Patent
Tsukada et al.

(10) Patent No.: US 8,092,407 B2
(45) Date of Patent: Jan. 10, 2012

(54) MASSAGE MACHINE

(75) Inventors: Daisuke Tsukada, Hikone (JP); Motoharu Muto, Hikone (JP); Satoshi Kajiyama, Hikone (JP); Hiroki Inoue, Hikone (JP); Masayuki Suzuki, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 1224 days.

(21) Appl. No.: 11/577,158

(22) PCT Filed: Oct. 13, 2005

(86) PCT No.: PCT/JP2005/018833

§ 371 (c)(1),
(2), (4) Date: Jul. 3, 2007

(87) PCT Pub. No.: WO2006/041112

PCT Pub. Date: Apr. 20, 2006

(65) Prior Publication Data

US 2008/0097260 A1 Apr. 24, 2008

(30) Foreign Application Priority Data

Oct. 14, 2004 (JP) ..... 2004-299826

(51) Int. Cl.
*A61H 15/00* (2006.01)

(52) U.S. Cl. ..... 601/97; 601/98; 601/100; 601/101; 601/103

(58) Field of Classification Search ..... 601/49, 601/51, 52, 84, 86, 87, 90, 93, 94, 97, 98, 601/99, 100, 101, 102, 103, 107, 108, 111; 388/811; 318/439, 599

See application file for complete search history.

(56) References Cited

U.S. PATENT DOCUMENTS 5,233,973 A * 8/1993 Gill et al. ..... 601/103

(Continued)

FOREIGN PATENT DOCUMENTS

JP 4-368488 12/1992

(Continued)

OTHER PUBLICATIONS

English language Abstract of JP 2004-229756.

(Continued)

*Primary Examiner* — Quang D Thanh

(74) *Attorney, Agent, or Firm* — Greenblum & Bernstein P.L.C.

(57) ABSTRACT

A massage machine using a small size and high torque brushless DC motor includes a driving unit moved up and down along guide rails of a chair and a first motor for moving the driving unit up and down. A pair of treatment head bases are driven reciprocally in opposite directions to each other; and a second motor reciprocally drives the treatment head bases in opposite directions to each other. Treatment heads are respectively supported by the treatment head bases; and a third motor drives the treatment heads in a plane substantially perpendicular to a backrest. A control circuit drives the respective motors respectively independently of one another. Each motor is a brushless motor. A control circuit corrects, corresponding to a load imposed on the brushless DC motor, a waveform of a drive signal applied to a winding of the brushless DC motor so as to allow a current flowing through the winding of the brushless DC motor to have a substantially sinusoidal waveform making it possible to reduce discomfort due to motor noise, and to accurately control the motor rotation speed.

13 Claims, 13 Drawing Sheets

U.S. PATENT DOCUMENTS

| | | | | |
|---|---|---|---|---|
| 5,265,590 | A * | 11/1993 | Takagi | 601/52 |
| 5,625,264 | A * | 4/1997 | Yoon | 318/400.06 |
| 6,316,895 | B1 * | 11/2001 | Ramarathnam | 318/599 |
| 2005/0101890 | A1 | 5/2005 | Mizoguchi et al. | |
| 2006/0111653 | A1 | 5/2006 | Nishio et al. | |
| 2007/0149906 | A1 | 6/2007 | Mizoguchi et al. | |

FOREIGN PATENT DOCUMENTS

| | | |
|---|---|---|
| JP | 2003-79084 | 3/2003 |
| JP | 2003-284382 | 10/2003 |
| JP | 2004-120841 | 4/2004 |
| JP | 2004-208341 | 7/2004 |
| JP | 2004-229756 | 8/2004 |

OTHER PUBLICATIONS

English language Abstract of JP 2004-120841.
English language Abstract of JP 4-368488.
English language Abstract of JP 2003-284382.
English language Abstract of JP 2004-208341.
English language Abstract of JP 2003-79084.

* cited by examiner

MASSAGE MACHINE

TECHNICAL FIELD

The present invention relates to a massage machine for driving treatment heads to trace a three-dimensional trajectory so as to perform various treatments.

BACKGROUND ART

A massage machine with substantially spherical treatment heads called massage balls driven to trace a three-dimensional trajectory uses, for example, three motors which are driven independently of one another. Treatments such as acupressure, massage and spine stretching are performed by combining an up/down movement along a backrest of a chair, a reciprocal movement in the width direction of the chair (width adjustment) and a revolving movement (back-and-forth movement) of the treatment heads. In recent years, following to complexity of the three-dimensional operations (called hand techniques) of the treatment heads, it is necessary to switch a motor in a short time between a low speed rotation and a high speed rotation, and to frequently switch the motor between a normal rotation and a reverse rotation.

A human body is a load in the massage machine, in which the load significantly varies depending on the figure of a user and the way he or she sits. Furthermore, when the user moves the body during treatment, it causes a weight shift, which leads to significant load change during the treatment. Therefore, a DC motor, particularly a brushed DC motor, is widely used conventionally as a motor which is capable of switching of the rotation speed in a short time and the rotation direction between the normal rotation and the reverse rotation, and which has a high torque. Generally, a high torque brushed DC motor has a feature that it has a large external shape and a heavy weight. Thus, it has been difficult to reduce the size and weight of the massage machine itself. Although there is a massage machine using a small sized brushed DC motor, the motor has a low torque, so that it is difficult to obtain sufficient treatment effects.

On the other hand, since a brushless DC motor is small in size, and superior in maintenance and durability, the use of a brushless DC motor as a driving source for a massage machine has been considered. However, although a brushless DC motor enables to achieve a small sized and high torque (high output) motor, it causes a new problem when used in a massage machine with large load change. More specifically, in the case of using a general 3-phase 4-pole brushless DC motor, the torque significantly varies due to cogging so that acoustic noises of the motor becomes larger if it is driven by a 120-degrees rectangular wave current. Since these noises are transmitted to a human body via the treatment heads, it causes discomfort to a user when a portion near the head such as neck or shoulder is treated. On the other hand, if emphasis is placed on low noise and low vibration, it might be considered to drive a brushless DC motor by sinusoidal wave current. However, it is required to detect the rotation angle of a rotor of the brushless DC motor with high accuracy, and to use an encoder and the like, so that it becomes a factor to prevent reduction in cost, size and weight. Furthermore, in case that a brushless DC motor is controlled by sinusoidal wave driving, it is required to apply currents at intervals of an electrical angle of 180 degrees. However, assuming that a brushless DC motor is used for a massage machine as described above, the sinusoidal wave drive makes it impossible to start or difficult to smoothly start the brushless DC motor because the load is not constant.

In particular, if the motor is not smoothly switched between the normal rotation and the reverse rotation, the treatment heads stop instantaneously, so that the user sensitively recognizes that the treatment heads have stopped. Furthermore, if the motors are driven to allow the treatment heads to trace a predetermined three-dimensional trajectory, it is required to synchronously drive three motors. However, when the rotation speed of an output shaft of a motor (hereafter referred to simply as rotation speed of a motor) deviates from a predetermined speed due to the load change or the like, the treatment heads are driven to trace a trajectory different from the intended trajectory. Thus, there is a possibility that the user cannot obtain a comfortable massage effect.

DISCLOSURE OF INVENTION

An object of the present invention is to provide a massage machine using a small sized and high torque brushless DC motor to drive especially a driving shaft which receives a heavy load, in which discomfort due to acoustic noises of motors are reduced, and the motor rotation speed is controlled as accurately as possible to enable treatment heads to trace an intended trajectory corresponding to hand techniques, thereby obtaining a comfortable massage effect.

A massage machine in accordance with an aspect of the present invention comprises: a chair; a driving unit which itself moves up and down along guide rails provided on a backrest of the chair; a first motor that moves the driving unit up and down along the guide rails; a pair of treatment head bases provided in the driving unit and driven reciprocally in opposite directions to each other along widthwise direction of the chair; a second motor that reciprocally drives the pair of treatment head bases in opposite directions to each other; treatment heads respectively supported on the pair of treatment head bases, and driven so that a major component of motion is in a plane substantially perpendicular to the backrest of the chair; a third motor that drives the treatment heads so that the major component of motion becomes substantially perpendicular to the backrest of the chair; and a control circuit that drives the first motor, the second motor and the third motor respectively independently of one another, and wherein at least one of the first motor, the second motor and the third motor is a brushless DC motor, and the control circuit corrects a waveform of a drive signal applied to a winding of the brushless DC motor corresponding to a load imposed on the brushless DC motor, so as to allow a current flowing through a winding of the brushless DC motor to have a substantially sinusoidal waveform.

According to such a configuration, the first motor, the second motor and the third motor are driven respectively independently of one another, so that it is possible to drive the treatment heads to trace an arbitrary three-dimensional trajectory. Then, the brushless DC motor is used for at least one of the first motor, the second motor and the third motor, preferably as a motor to drive a driving shaft with large load change, so that it is possible to achieve a small size and a high output of the motor at the same time. In addition, since the control circuit corrects waveforms of driving signals applied to the winding of the brushless DC motor corresponding to the load imposed on the brushless DC motor so as to allow the current flowing through the winding of the brushless DC motor to be a substantially sinusoidal waveform, the brushless DC motor is driven by a substantially sinusoidal waveform regardless of load variations, and thereby achieving low noise and low vibration of the motor. Accordingly, it does not cause discomfort to a user even when a portion near the head such as neck or shoulder is treated. Furthermore, with using a brushless DC motor having a high output, it is possible to control the rotation speed of the motor as accurately as possible to enable the treatment heads to trace an intended trajectory corresponding to hand techniques, so that it is possible to obtain a comfortable massage effect.

BEST MODE FOR CARRYING OUT THE INVENTION

Figure 1:
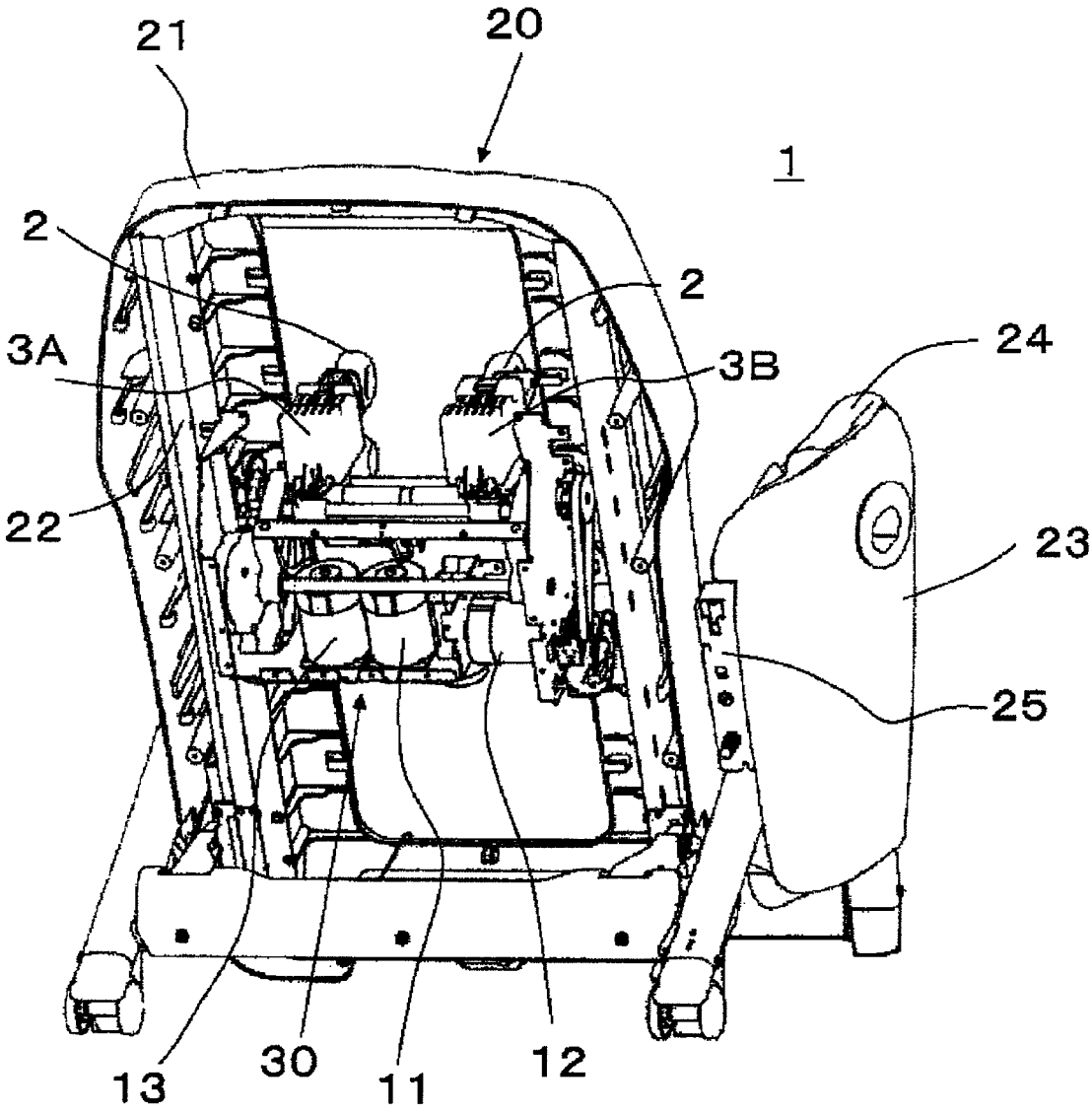
FIG. 1 is a perspective view showing a configuration of a backrest of a massage machine in accordance with an embodiment of the present invention as seen from a rear side thereof.
Figure 2:
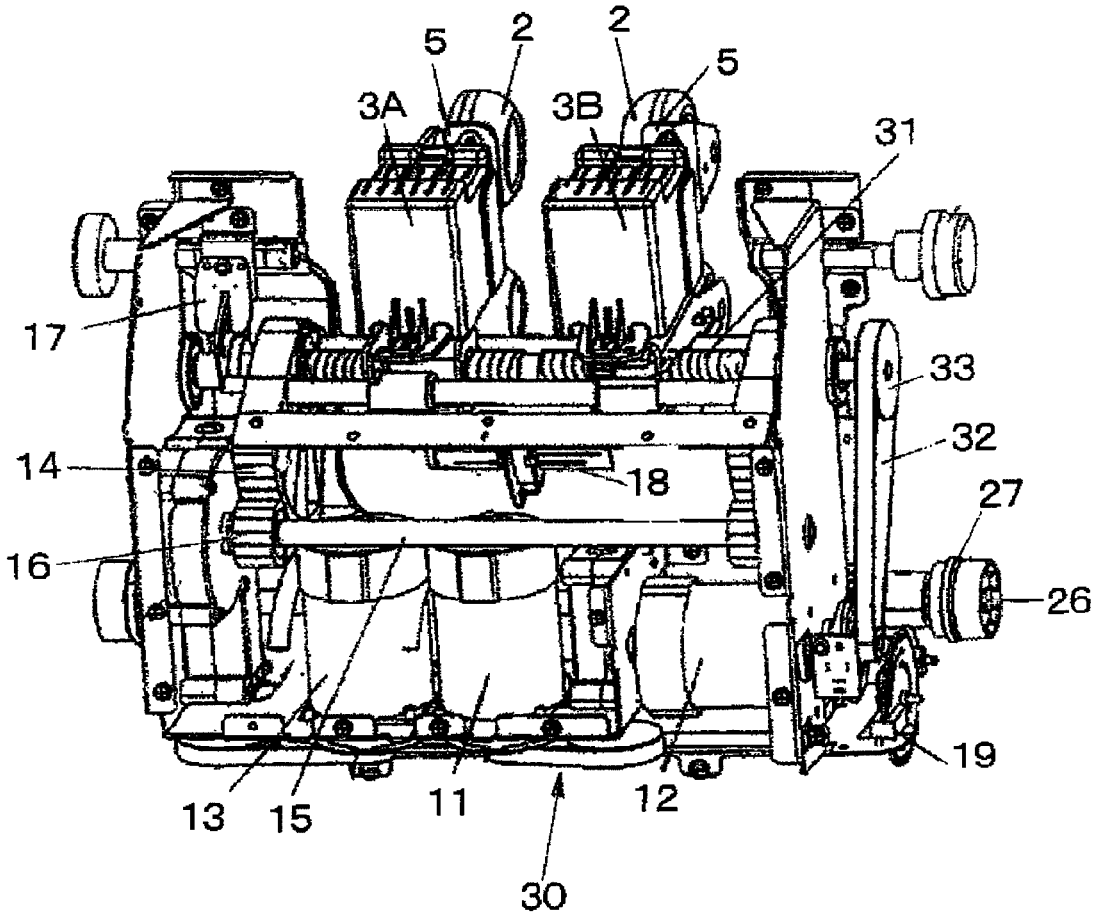
FIG. 2 is a perspective view showing a configuration of a driving unit of the massage machine.

A massage machine in accordance with an embodiment of the present invention will be described. FIG. 1 shows a configuration of the massage machine in accordance with the present embodiment as seen from a rear side of a backrest thereof. FIG. 2 shows a configuration of a driving unit of the massage machine.

As shown in FIG. 1, the massage machine 1 in accordance with the present embodiment comprises: a chair 20; a driving unit 30 which itself moves up and down along guide rails 22 provided on a backrest 21 of the chair 20; an operation switch 24 and a control circuit 25 which are provided on armrests 23; and so on.

The driving unit 30 comprises a first motor 11 that rotates and drives a first driving shaft 26 via a gear mechanism not shown in the figure. Pinions 27 which engage with racks (not shown in the figure) of the guide rails 22 are fixed on the first driving shaft 26. Thus, by switching the first motor 11 between a normal rotation and a reverse rotation, the driving unit 30 in its entirety is moved up and down along the guide rails 22.

In the driving unit 30, a pair of treatment head bases 3A and 3B, which is driven reciprocally in opposite directions to each other along the widthwise direction of the chair 20, is supported by a second driving shaft 31 which is provided substantially horizontally. For example, male threads which are directed opposite to each other are formed on a peripheral surface of the second driving shaft 31 in regions where the respective treatment head bases 3A and 3B are reciprocally driven. On the other hand, female threads which are directed opposite to each other and are screwed onto the male threads of the second driving shaft 31 are formed on the respective treatment head bases 3A and 3B. The second driving shaft 31 is driven and rotated by a second motor 12 via a belt 32, a pulley 33 and so on. By switching the second motor 12 between a normal rotation and a reverse rotation, the pair of treatment head bases 3A and 3B is driven reciprocally in opposite directions to each other.

Treatment heads (massage balls) 2 mounted on front ends of arms 5 are supported on the respective treatment head bases 3A and 3B. The respective arms 5 are linked to a pair of sector gears 14 which revolve around the second driving shaft 31, and move with the revolution of the respective sector gears 14 in a plane substantially perpendicular to the backrest 21 of the chair 20. The sector gears 14 are engaged with gears 16 for drive force transmission which are fixed near both ends of a third driving shaft 15 provided substantially horizontally, so that they are revolved by the rotation of the third driving shaft 15. A third motor 13 is coupled to the third driving shaft 15 via a gear mechanism not shown in the figure, so that the sector gears 14 are reciprocally revolved in a predetermined region by switching the third motor between a normal rotation and a reverse rotation. Corresponding to such motions, the treatment heads 2 mounted on the front ends of the arms 5 are driven in a manner so that a major component of the motion becomes substantially perpendicular to the backrest 21 of the chair 20. Note that the treatment heads 2 are not necessarily moved only in a plane perpendicular to the backrest 21. Depending on the shape or configuration of the arms 5, for example, when the arms 5 are bent in the middle, the treatment heads 2 move in a directional component which is not perpendicular to the backrest 21. Thus, as described above, it is sufficient that the treatment heads 2 are driven so that the major component of motion is substantially perpendicular to the backrest 21 of the chair 20.

A first position detecting sensor 17 is provided on the second driving shaft 31 for detecting movements of the arms 5, that is, positions of the treatment heads 2 in a plane substantially perpendicular to the backrest 21 of the chair 20. Furthermore, a second sensor 18 for detecting positions of respective of the treatment head bases 3A and 3B is provided near rear faces of the treatment head bases 3A and 3B. Still furthermore, a third sensor 19 is provided near the side of the driving unit 30 for detecting vertical position of the driving unit 30 along the guide rails 22 provided on the backrest 21 of the chair 20.

The control circuit 25 drives the first motor 11, the second motor 12 and the third motor 13, respectively independently of one another. Thereby, the treatment heads 2 are respectively driven to trace predetermined three-dimensional trajectories. Respective outputs of the first sensor 17, the second sensor 18 and the third sensor 19 are input to the control circuit 25, so that the control circuit compares the three-dimensional trajectory of the treatment heads 2 corresponding to predetermined hand techniques with current positional information of the treatment heads 2 calculated from the outputs of the respective sensors 17 to 19, while monitoring the outputs from the respective sensors 17 to 19. Then, it controls rotation speeds and rotation directions of the respective motors so as to enable the respective treatment heads 2 to trace trajectories as close as possible to the trajectories corresponding to the predetermined hand techniques.

Hereupon, in the present embodiment, small size and high torque brushless DC motors are used as the first motor 11, the second motor 12 and the third motor 13. According to loads imposed on the brushless DC motors, the control circuit 25 corrects the waveforms of driving signals applied to windings of the brushless DC motors so as to allow currents flowing through the windings of the brushless DC motors to have a substantially sinusoidal waveform (shape as close as possible to a sinusoidal wave).

Figure 3:
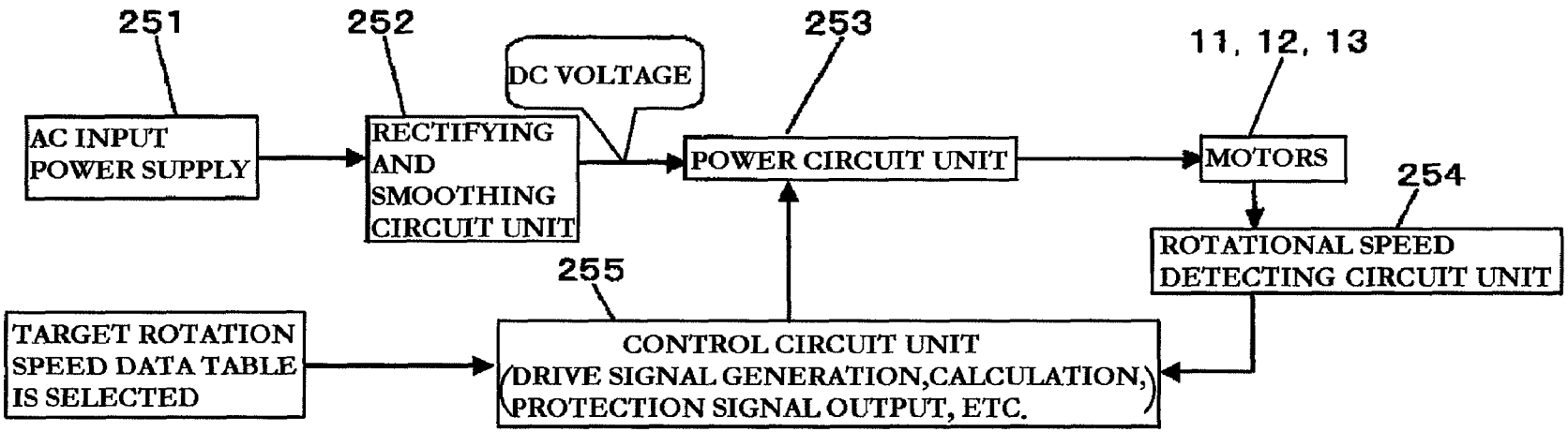
FIG. 3 is a block diagram showing a basic configuration of a control circuit of the massage machine.

A basic block diagram of the control circuit 25 is shown in FIG. 3. A voltage supplied from an AC input power supply 251 is converted to a DC voltage having a small voltage variation by a rectifying and smoothing circuit unit 252 which is comprised of a rectifying diode, an aluminum electrolytic capacitor and so on, and is supplied to a power circuit 253. The power circuit unit 253 has high frequency diodes for free wheeling, such as IGBT or FET, which are connected in anti-parallel, thereby forming a bridge circuit. A control circuit unit 255 is formed of a microcomputer and so on, and processes information obtained by a rotation number detecting circuit unit 254 so as to generate driving signals, and further transmits the driving signals to the power circuit unit 253. The motors 11, 12 and 13 are driven based on the transmitted signals. When a data table of target rotation speeds is designated by a microcomputer which controls overall the machine, the control circuit unit 255 controls the rotation speeds of the respective motors 11, 12 and 13 by setting the rotation speeds of them listed in the table to be target rotation speeds at each time of rotating predetermined rotation numbers. The control circuit unit 255 serves as: a rotation speed calculating means that calculates rotation speeds of the motors by counting time periods between signals outputted from Hall ICs (rotation number detecting circuit unit 254) built-in in the brushless DC motors (motors 11, 12 and 13); a speed control means that compares target rotation speeds with the rotation speeds obtained by the calculation and conforms the rotation speeds obtained by the calculation to the target rotation speeds; and a voltage control means that controls pulse voltages applied to the windings of the brushless DC motors by pulse width modulation (PWM) control with using a target sinusoidal waveform and a triangular waveform having a predetermined carrier frequency so as to allow the currents flowing through the windings of the brushless DC motors to have substantially sinusoidal waveforms.

Figure 4:
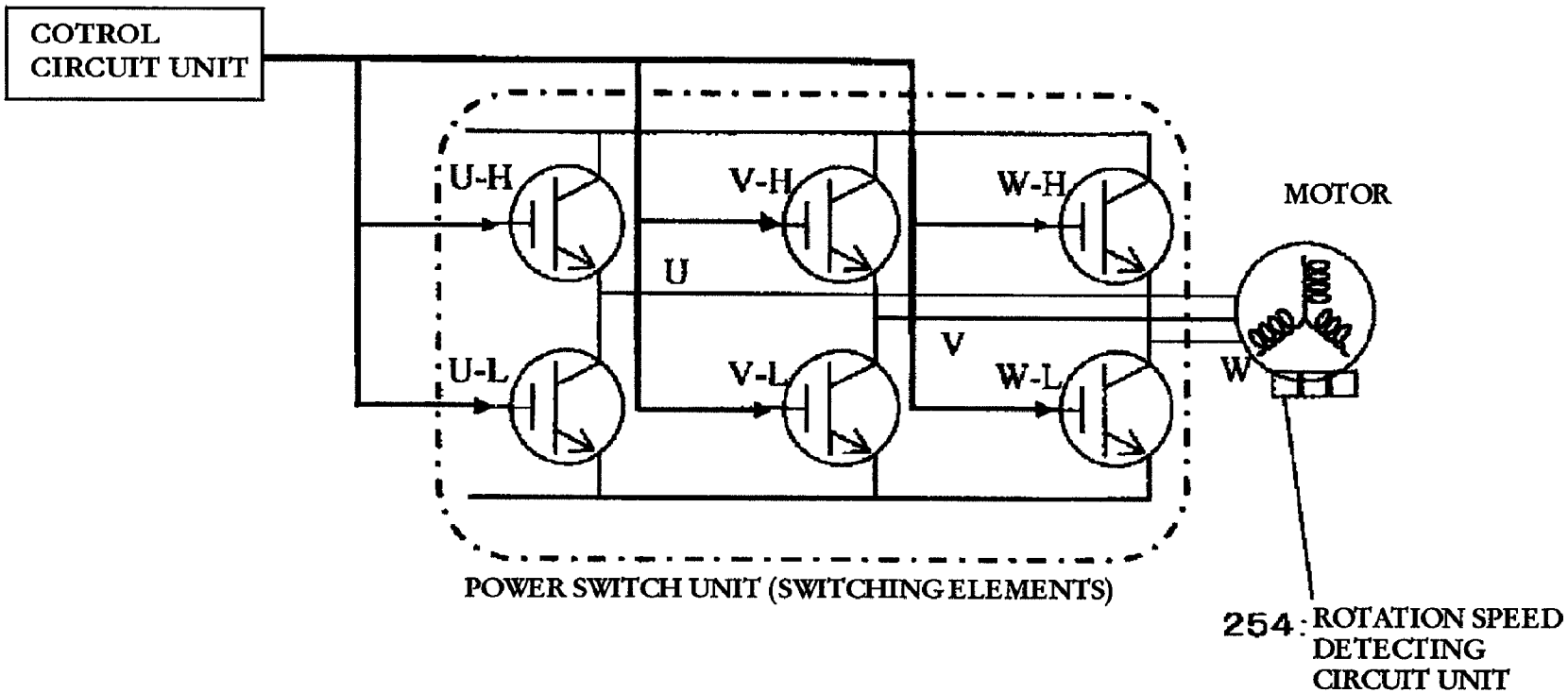
FIG. 4 is a circuit diagram showing a configuration of a power circuit in a case where a 3-phase 4-pole brushless DC motor is used.

A configuration of the power circuit unit 253 in the case where a 3-phase 4-pole brushless DC motor is used as each of the motors 11, 12 and 13 are shown in FIG. 4. As for the above-described rotation speed detecting circuit unit 254, three Hall ICs provided in each of the motors 11, 12 and 13 are used and signals from the Hall ICs are taken in the control circuit unit 255, so that it is possible to determine the position of the rotor at intervals of an electrical angle of 120 degrees. The control circuit unit 255 outputs signals for controlling respective switching elements U-H, U-L, V-H, V-L, W-H and W-L of the power circuit unit 253 based on the signals from the Hall ICs, and thereby, it controls the timing to supply currents.

The control circuit unit 255 has: a program to obtain rotation speeds by calculation with counting time periods between the respective signals from the three Hall ICs of each of the motors 11, 12 and 13; a speed control program for comparing the target rotation speeds with the measured rotation speeds so as to adjust them to the target rotation speeds; and a program for controlling the voltages applied to the respective winding of the respective motors so as to allow the currents flowing through the windings of the respective motors 11, 12 and 13 to have substantially sinusoidal waveforms. Note that this control is referred to a sinusoidal wave drive.

Figure 5:
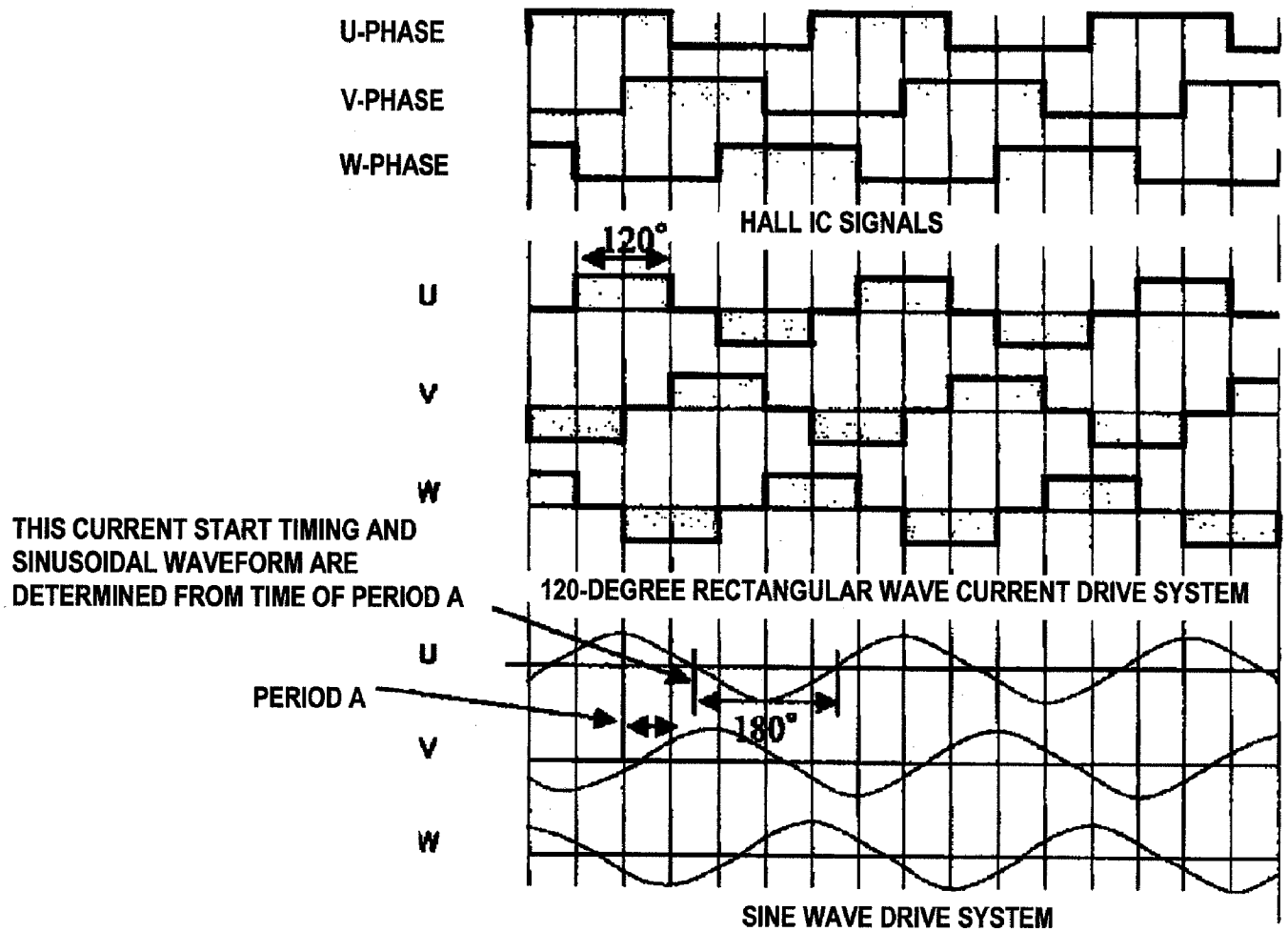
FIG. 5 is a waveform chart showing signals from respective Hall ICs and current timings in a motor driven by 120-degree rectangular wave currents as well as signals from respective Hall ICs and current timings in a motor driven by sinusoidal waves.

Subsequently, signals from respective Hall ICs and timings to supply currents in a motor driven by a 120-degree rectangular wave as well as signals from respective Hall ICs and timings to supply currents in a motor driven by a sinusoidal wave are shown in FIG. 5. In order to actually perform the drive by a sinusoidal wave, it is required to apply the currents at intervals of an electrical angle of 180 degrees as shown in FIG. 5. However, the timings when the currents are supplied cannot be measured directly by the Hall ICs. Thus, the control circuit unit 255 determines the timings to start to supply the currents by inferring from the rotation speed obtained by calculation.

Figure 6:
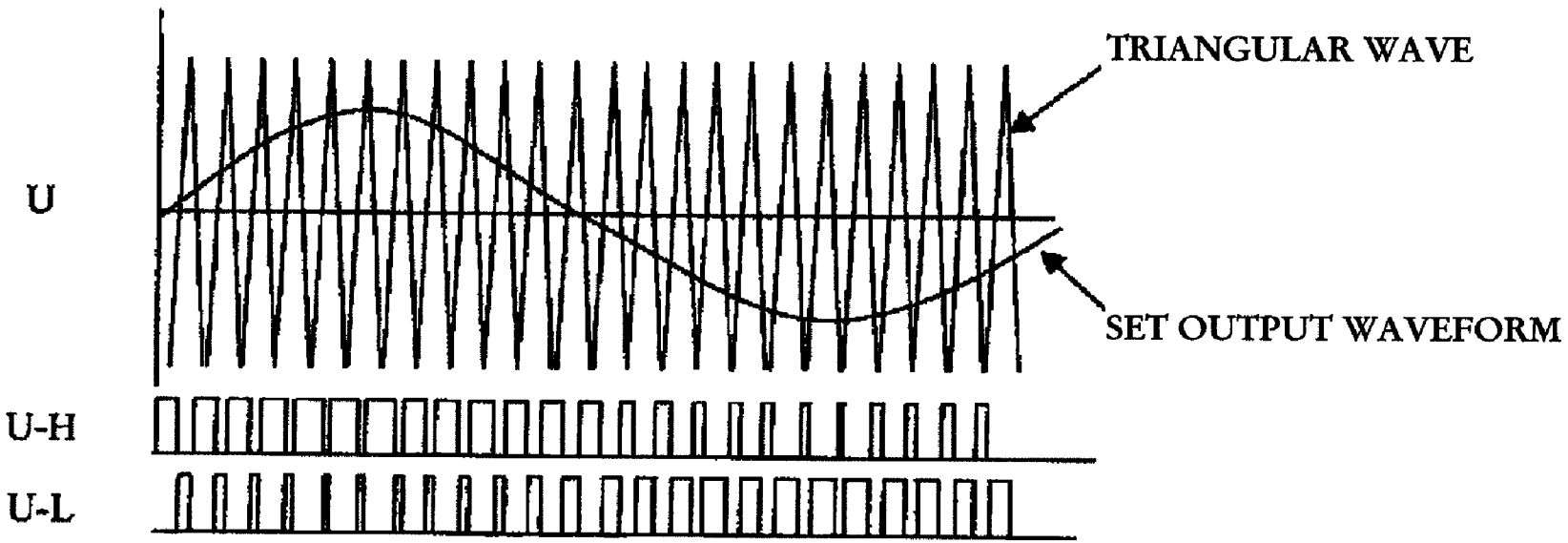
FIG. 6 is a waveform chart showing a basic principle for generating a pulse width modulation (PWM)-controlled pulse voltages applied to a winding of each motor with using a target sinusoidal waveform and a triangular waveform having a predetermined carrier frequency.

In order to allow the currents flowing through the windings of the respective motors 11, 12 and 13 to have substantially sinusoidal waveforms, the control circuit unit 255 controls pulse voltages applied to the windings of the respective motors by pulse width modulation (PWM) control with using a target sinusoidal waveform and a triangular waveform having a predetermined carrier frequency (for example, 20 kHz). For example, as shown in FIG. 6, the target sinusoidal wave and the triangular wave having a predetermined carrier frequency are overlaid on each other, so as to define a pulse width as a time period from the time when both intersect to the time when they next intersect. According to such a manner, the pulse widths of pulse voltages applied to the windings of the respective motors 11, 12 and 13 are modulated in sinusoidal, so that the currents flowing through the windings of the respective motors 11, 12 and 13 are also controlled to have a substantially sinusoidal waveform. In addition, the target sinusoidal waves are decided by rewriting the sinusoidal waveforms previously stored in, for example, a memory of the control circuit unit 255 to data corresponding to the position of the rotor, and further multiplying a voltage amplitude command value commanded by the speed control program to the rewritten data.

In the case of the massage machine 1, the load significantly varies depending on the figure of a user and the way he or she sits. Furthermore, when the user moves the body during treatment, it causes a weight shift so that the load varies during the treatment. Although the rotation speeds of the respective motors 11, 12 and 13 are varied corresponding to the variation of the load, the variation of the rotation speeds are detected by the control circuit unit 255 as variations of the signals from the Hall ICs (rotation speed detecting circuit unit 254) provided in the respective motors 11, 12 and 13. The control circuit unit 255 controls the timings to control the turning on/off of the switching elements U-H, U-L, V-H, V-L, W-H and W-L of the power circuit unit 253 by feedback control, so as to allow the rotation numbers of the motors 11, 12 and 13 to be predetermined rotation numbers. Thereby, the waveforms of the driving signals applied to the respective motors 11, 12 and 13 are corrected corresponding to the loads imposed on the motors 11, 12 and 13, so that the brushless DC motors are driven by substantially sinusoidal waves, and thereby, achieving low noise and low vibration of the motors, regardless of load variations. Particularly, even when a portion near the head such as neck or shoulder is treated, the acoustic noises of the motor can be reduced, so that it is possible to reduce the possibility of causing discomfort to the user even when the acoustic noises are transmitted to the user via the treatment heads.

Figure 7:
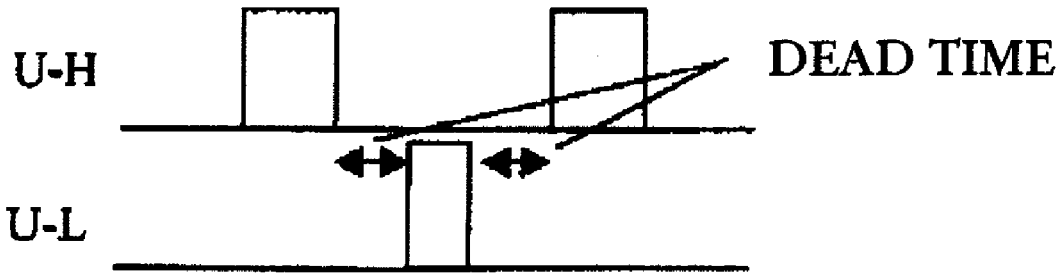
FIG. 7 is a waveform chart showing waveforms in a case where a dead time is provided in pulse waveforms of pulsating voltages which have been subjected to the PWM.

In addition, as shown in FIG. 6, an inversion signal of a signal applied to the U-H side is applied to the U-L side. At that time, by providing a time period (dead time) in which the U-H side and the U-L side are turned off simultaneously as shown in FIG. 7, it is possible to prevent that the U-H side and the U-L side are turned on simultaneously.

Figure 8:
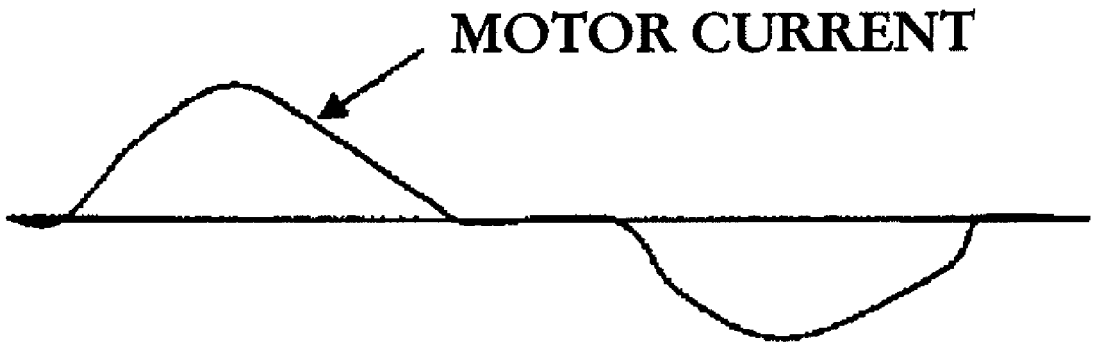
FIG. 8 is a graph showing a waveform of a current flowing through a winding of the motor in a case where a process is performed to provide a dead time with a constant value when a pulse width itself of pulse voltages which have been subjected to the PWM is small.

Meanwhile, when a motor rotates at a low speed particularly, further when the load is smaller), the command from the speed control program attempts to reduce the voltage amplitude command value so as to reduce current flowing through each winding. At that time, since the pulse width itself of the pulse voltage having been subjected to the PWM as described above becomes small, if a process is performed to provide a dead time with a constant value, the pulse width may become smaller than the dead time, and thereby, the pulse may be vanished. In such a case, the waveform of the current flowing through the winding of the motor may be deviated from a sinusoidal wave, for example, as shown in FIG. 8, and it may cause the acoustic noises of the motor. If the dead time is merely set to be smaller so as to prevent this problem, the current flowing through the winding of the motor becomes larger when the load is larger or the speed is faster. In an actual power element, since it needs a long time to turn off the current completely, a through current flows when the current is large, and it causes the breakdown of the power element, heating of the power element, and so on.

Thus, a circuit for detecting a current flowing through the winding of the motor may be provided independently, for example, and the control circuit unit 255 may perform a process to reduce the dead time corresponding to a value of the current. For example, it is possible to set a threshold value for the value of the current flowing through the winding of the motor, and to vary the length of the dead time depending on whether a detected value of the current is larger than the threshold value or not. Furthermore, it is also possible to set multiple threshold values so as to vary the length of the dead time at multiple steps. According to such configurations, it is possible to allow the current flowing through the motor to have a sinusoidal waveform even when the motor rotates at a low speed or the load of the motor is small, thereby making it possible to provide a quiet massage machine regardless of the figure or posture of the user.

However, the above-described method requires at least a current detection circuit, thereby complicating the circuit configuration of the control circuit 25, and becoming a factor to increase the cost. Thus, for example, it is also possible to estimate a current based on a voltage amplitude command value. In such a case, although the cost reduction is enabled because the current detection circuit can be eliminated, burden to be processed by the microcomputer constituting the control circuit unit 255 will be increased, so that an expensive microcomputer capable of high speed processing is required. Accordingly, these two cases are suitable for a high function and expensive massage machine. In contrast, it is possible to vary the dead time corresponding to the pulse width which is generated in a manner as shown in FIG. 6. For example, this can be achieved in a manner that when the pulse width becomes a predetermined threshold value (for example, a first dead time) or less, it is reset to a second dead time which is smaller than the first dead time. However, since the dead time cannot be made zero, it is necessary to set a lower limit value. According to such a configuration, it is possible not only to eliminate the current detection circuit, but also to reduce the burden to be processed by the microcomputer, so that it becomes possible to obtain an effect similar to that described above by using an inexpensive microcomputer with a slow processing speed. This case is suitable for an inexpensive massage machine with relatively limited function. Furthermore, it is also possible to estimate the current based on the rotation speed of the motor. This enables to reduce the cost because it eliminates the current detection circuit. In addition, the control circuit unit 225 (sic, correctly: 255) obtains the rotation speed of the motor periodically by calculation, so that the burden to be processed by the microcomputer which configures the control circuit unit 255 may not be increased.

Figure 9:
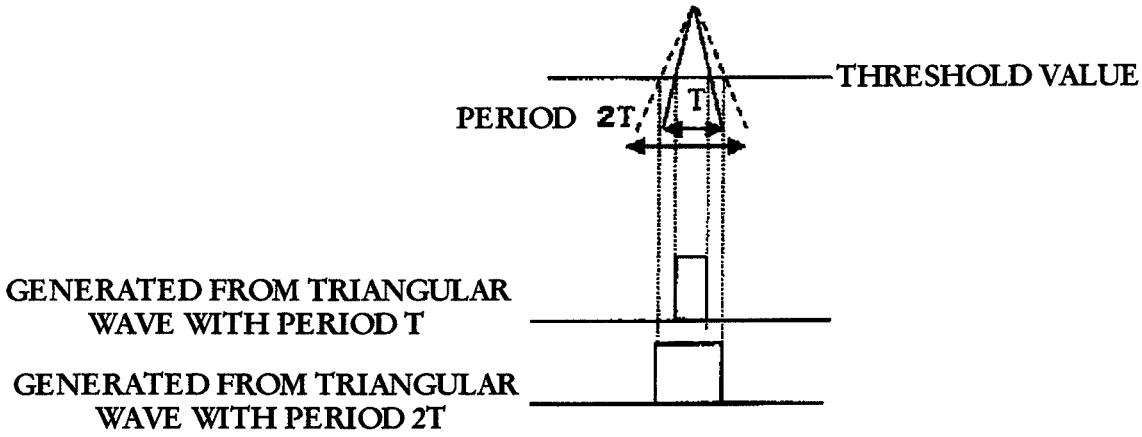
FIG. 9 is a waveform chart for explaining that a pulse width of a generated pulse voltage is expanded by reducing a carrier frequency of sinusoidal waves.

In addition, it may be configured to reduce the carrier frequency of a triangular wave when the current flowing through the winding of the motor is small. For example, when the carrier frequency of the triangular wave shown in FIG. 6 is reduced to ½ from 20 kHz to 10 kHz, then the pulse width of a pulse voltage generated thereby is expanded twice as shown in FIG. 9. Therefore, it is possible to prevent the pulse from vanishing, even when the dead time is set at a constant value. In addition, it is preferable to set the carrier frequency as higher as possible, because when the carrier frequency is reduced, acoustic noises near the audible range may be outputted from a circuit, for example. Therefore, it is possible to configure that the carrier frequency is gradually reduced corresponding to the amount of current. Furthermore, when considering variations of the amount of signal delay caused by circuit variations, for example, there is a high risk to flow the through current to the power element and so on when the dead time is made too small. In contrast, by changing the carrier frequency without changing the dead time, the suspected risk can be avoided, and the motor can be driven more safely.

Figure 10:
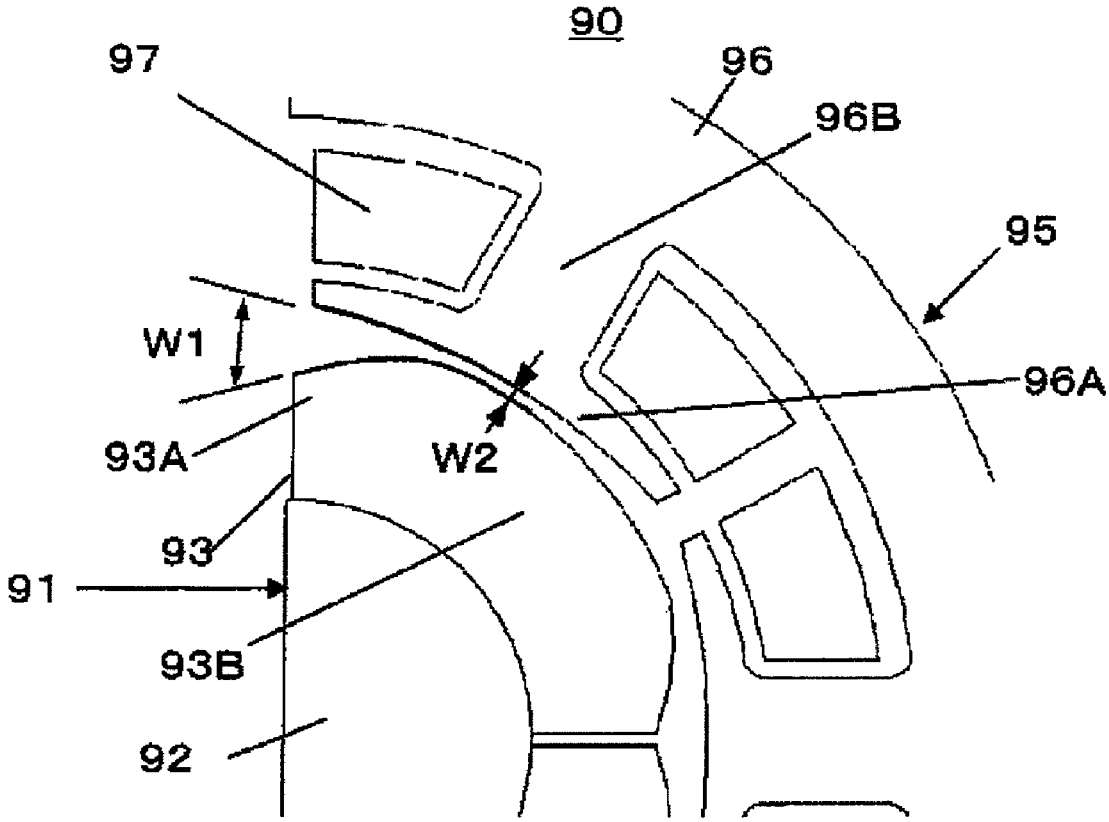
FIG. 10 is a view showing a configuration of a portion of a brushless DC motor suitable for the massage machine in accordance with the above-described embodiment.
Figure 11:
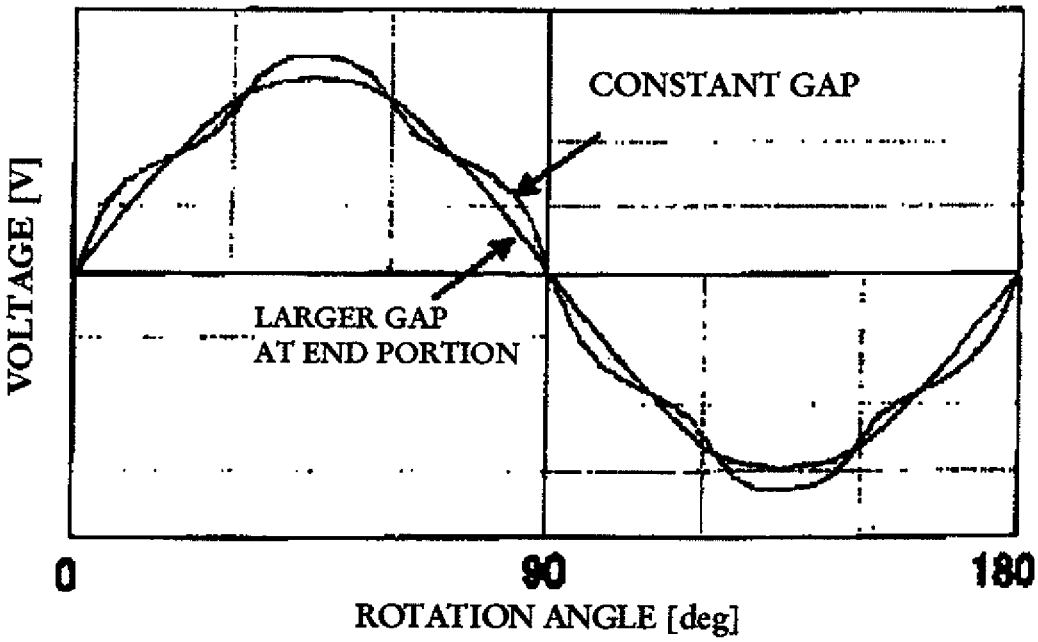
FIG. 11 is a graph showing counter electromotive voltages obtained by subjecting a magnetic circuit of the brushless DC motor shown in FIG. 10 to magnetic analysis.

Subsequently, a brushless DC motor suitable for the massage machine will be described. FIG. 10 schematically shows a portion of a magnetic circuit in a 3-phase 4-pole surface magnet type motor as such a brushless DC motor 90. Furthermore, FIG. 11 shows counter electromotive voltages obtained by subjecting the magnetic circuit of the brushless DC motor shown in FIG. 10 to magnetic analysis.

As shown in FIG. 10, a rotor 91 of the brushless DC motor 90 is formed with multiple substantially arc-shaped permanent magnets 93 bonded to an outer peripheral surface of a substantially cylindrically shaped iron core 92. Both end portions 93A of each permanent magnet 93 in its circumferential direction is formed thinner than another portion such as near a central portion thereof. On the other hand, an iron core 96 of a stator 95 has T-shaped portions 96A protruding toward the rotor 91, while a winding 97 is wound around trunk 96B of the T-shaped portions 96A. According to such a configuration, a gap W1 between both end portions 93A of the permanent magnets 93 and the T-shaped portions 96A of the iron core 96 of the stator 95 becomes wider (larger) than a gap W2 between the central portions 93B of the permanent magnets 93 of the rotor 91 and the T-shaped portions 96A of the iron core 96 of the stator 95. By forming the gap between the permanent magnets 93 of the rotor 91 and the T-shaped portions 96A of the iron core 96 of the stator 95 unevenly, it is possible to reduce concentration of magnetic flux on the end portions 93A of the permanent magnets 93 in comparison with the case where the thickness of the substantially arc-shaped permanent magnets is made uniform to form a gap evenly. When the concentration of the magnetic flux in the end portions 93A of the permanent magnets 93 is reduced, the magnetic fluxes of N-pole and S-pole can be switched smoothly, so that the counter electromotive voltage approaches a sinusoidal waveform as shown in FIG. 11. Consequently, a high efficient and low noise driving can be achieved in cooperation with the voltage having a sinusoidal waveform applied to the winding of the motor.

Figure 12A:
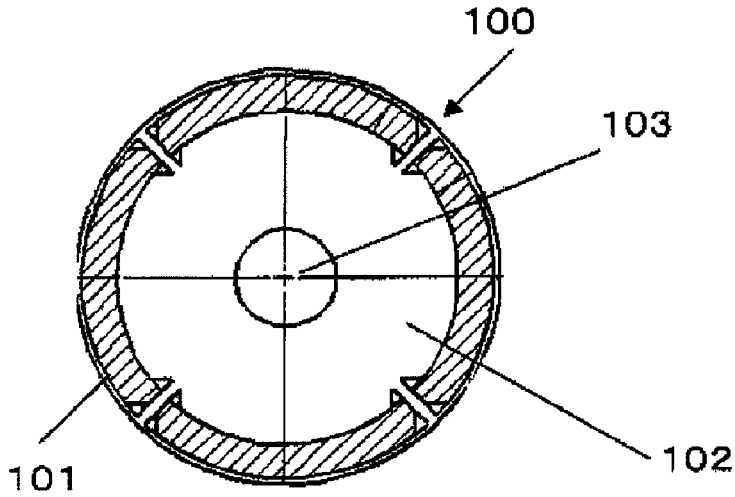
FIG. 12A is a cross-sectional view showing a configuration of another brushless DC motor suitable for the massage machine in accordance with the above-described embodiment.
Figure 12B:
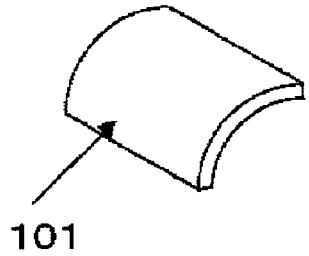
FIG. 12B is a perspective view showing a shape of a permanent magnet used in this brushless DC motor.

Subsequently, a configuration of another brushless DC motor suitable for the massage machine is shown in FIG. 12. FIG. 12B shows a shape of a permanent magnet used in this brushless DC motor. Furthermore, FIG. 13 shows counter electromotive voltages obtained by subjecting a magnetic circuit of the brushless DC motor shown in FIG. 12 to magnetic analysis.

As shown in FIG. 12A, a rotor 100 of the brushless DC motor has a an interior permanent-magnet (IPM) configuration, and multiple permanent magnets 101 having a substantially arc-shaped cross section are embedded in the circumferential direction, as shown in FIG. 12B. The rotor 100 rotates about a rotation axis 103 as a center. Furthermore, substantially arc-shaped holes are formed on an iron core 102 of the rotor 100 at four locations, and the substantially arc-shaped permanent magnets 101 are embedded in respective ones of them.

Figure 13:
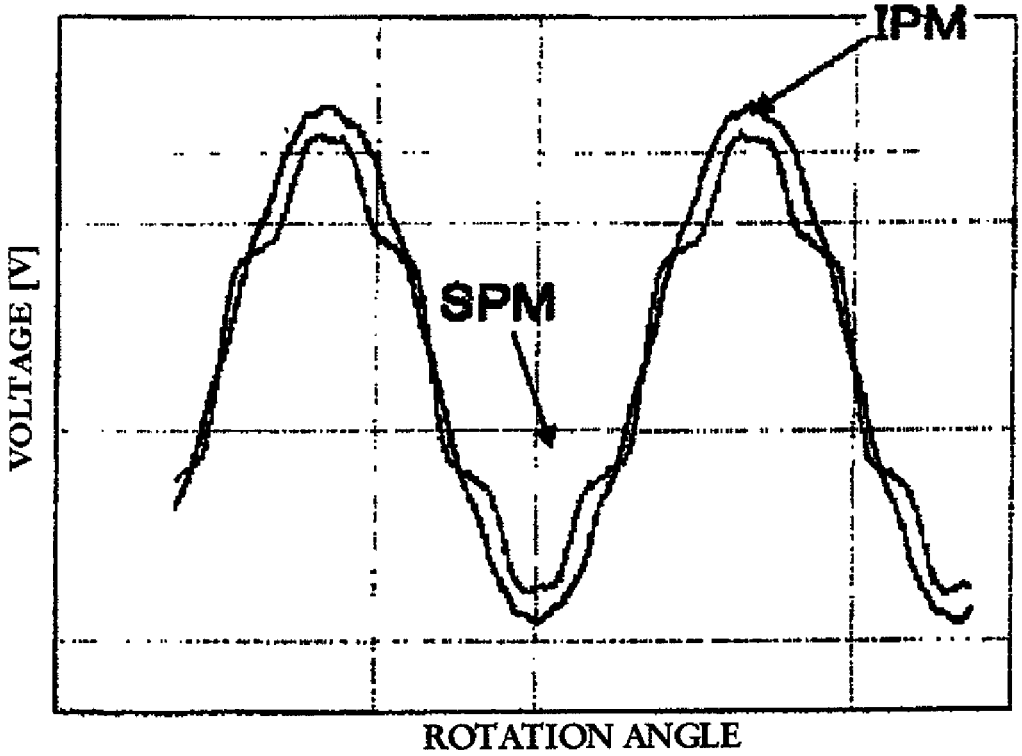
FIG. 13 is a graph showing counter electromotive voltages obtained by subjecting a magnetic circuit of the brushless DC motor shown in FIG. 12A to magnetic analysis.

In comparison with a surface permanent-magnet (SPM) configuration where magnets are bonded on a surface of an iron core, the counter electromotive force is disturbed as shown in FIG. 13 due to magnetic flux concentration on ends of magnets in the SPM configuration. In contrast, when taking an appropriate IPM configuration as shown in FIG. 12, it possible to reduce the concentration of magnetic flux on the ends of the magnets and to allow the counter electromotive voltage to approach a sinusoidal waveform. Consequently, a high efficient and low noise driving can be achieved in cooperation with the voltage having a sinusoidal waveform applied to the winding of the motor. Furthermore, it is also possible to increase drive efficiency because rotation is performed using not only magnetic force but also reactance force.

Although the above-described embodiment has shown an example in which brushless DC motors are used for all the three motors, the present invention is not limited to this. A brushed DC motor, for example, can be used as a motor to drive a driving shaft which does not contribute to hand techniques.

Furthermore, the present invention is not limited to a massage machine, such as in the above-described embodiment, using three motors driven independently of one another, and can be applied to all massage machines with treatment heads driven to trace a three-dimensional trajectory so as to perform treatments. Regardless of the configuration of the massage machine, an effect similar to that described above can be obtained when the brushless DC motor is used as a motor which is switched between the normal rotation and the reverse rotation at least once while the treatment heads traces a three-dimensional trajectory once, and a control circuit for driving the brushless DC motor corrects a waveform of a driving signal applied to a winding of the brushless DC motor corresponding to a load imposed on the brushless DC motor, a waveform of a drive signal applied to a winding of the brushless DC motor so as to allow a current flowing through the winding of the brushless DC motor to have a substantially sinusoidal waveform.

In other words, a massage machine in accordance with an aspect of the present invention is sufficient to comprise: a chair; a driving unit which itself moves up and down along guide rails provided on a backrest of the chair; a first motor that moves the driving unit up and down along the guide rails; a pair of treatment head bases provided in the driving unit and driven reciprocally in opposite directions to each other along widthwise direction of the chair; a second motor that reciprocally drives the pair of treatment head bases in opposite directions to each other; treatment heads respectively supported on the pair of treatment head bases, and driven so that a major component of motion is in a plane substantially perpendicular to the backrest of the chair; a third motor that drives the treatment heads so that the major component of motion becomes substantially perpendicular to the backrest of the chair; and a control circuit that drives the first motor, the second motor and the third motor respectively independently of one another, and wherein at least one of the first motor, the second motor and the third motor is a brushless DC motor, and the control circuit corrects a waveform of a drive signal applied to a winding of the brushless DC motor corresponding to a load imposed on the brushless DC motor, so as to allow a current flowing through a winding of the brushless DC motor to have a substantially sinusoidal waveform.

In the above-described massage machine, it is preferable that the control circuit should comprise: a rotation speed calculating means that counts a time period between signals outputted from Hall ICs built-in in the brushless DC motor so as to calculate rotation speed of the motor; a speed control means that compares a target rotation speed with the rotation speed obtained by the calculation and conforms the rotation speed obtained by the calculation with the target rotation speed; and a voltage control means that controls a pulse voltage applied to the winding of the brushless DC motor by pulse width modulation (PWM) control with using a target sinusoidal waveform and a triangular waveform having a predetermined carrier frequency so as to allow the current flowing through the winding of the brushless DC motor to have a substantially sinusoidal waveform.

According to such a configuration, since the control circuit counts the time period between the signals outputted from Hall ICs built-in in the brushless DC motor so as to calculate rotation speed of the motor, it is possible to achieve the above-described massage machine with using no encoder, or the like. Furthermore, since it is possible to control the machine so as to compare the target rotation speed with the rotation speed obtained by the calculation and to conform the rotation speed obtained by the calculation with the target rotation speed, it is possible to control the rotation speed of the motor as accurately as possible to allow the treatment heads to trace an intended trajectory corresponding to hand techniques. Furthermore, the current flowing through the winding of the brushless DC motor is allowed to have a substantially sinusoidal waveform by controlling the pulse voltage applied to the winding of the brushless DC motor in pulse width modulation (PWM) control with using the target sinusoidal waveform and the triangular waveform having a predetermined carrier frequency, so that it is possible to achieve the control circuit by a common circuit configuration using the CPU, and so on. Thus, it is possible to prevent the cost increase of the massage machine.

Furthermore, it is preferable that the control circuit should comprise a current detecting means that detects the current flowing through the winding of the brushless DC motor, provides a dead time in the pulse voltage applied to the winding of the brushless DC motor, and reduces the dead time when a value of the current flowing through the winding of the brushless DC motor is small.

When performing the PWM control in the brushless DC motor, a predetermined pulse signal is applied to the H side of the winding, while its inversion signal is applied to the L side. Hereupon, a dead time, in which the H side and the L side are turned off simultaneously, is provided so as to prevent the H side and the L side from turning on simultaneously. On the other hand, when the brushless DC motor is rotated at a low speed, and especially, further when the load is smaller, the pulse width of the pulse voltage applied to the winding of the brushless DC motor is significantly reduced in order to reduce the current flowing through the winding of the brushless DC motor. In such a case, if the same dead time is constantly set, the pulse may substantially vanish due to the dead time, and the current flowing through the winding of the brushless DC motor significantly deviates from a sinusoidal waveform, which causes acoustic noises. According to the invention of claim 3 (SIC), it is configured to comprise the current detecting means for detecting the current flowing through the winding of the brushless DC motor, and the dead time is shortened when the value of the current flowing through the winding of the brushless DC motor is small, so that it is possible to prevent a situation where the pulse is vanished by setting the dead time, and occurrence of the acoustic noises can be reduced.

Furthermore, it is preferable that the control circuit should provide a dead time in the pulse voltage applied to the winding of the brushless DC motor, and vary the dead time corresponding to a pulse width of the pulse voltage applied to the brushless DC motor.

According to such a configuration, since the dead time is varied corresponding to the pulse width of the pulse voltage applied to the winding of the brushless DC motor, an effect similar to that described above can be obtained without using the current detecting means (current sensors). In particular, since a process concerning to the current detection is simplified, it is possible to reduce the burden imposed on the CPU. Consequently, it is also possible to use a low cost CPU, and thereby, the cost of the massage machine can be reduced.

Furthermore, it is preferable that the control circuit should comprise a current detecting means that detects the current flowing through the winding of the brushless DC motor, and reduce the carrier frequency of the triangular waveform when a value of the current flowing through the winding of the brushless DC motor is small.

According to such a configuration, since it is configured to reduce the carrier frequency of the triangular waveform when the value of the current flowing through the winding of the brushless DC motor is small, in contrast to the case of claim 2 or 3 (SIC), the pulse width of the pulse signal becomes larger. Consequently, even if the same dead time is set constantly, it is possible to prevent a situation where the pulse is substantially vanished by setting the dead time, and thereby, the occurrence of the acoustic noises can be reduced.

Furthermore, it is preferable that a rotor of the brushless DC motor should be configured so that multiple permanent magnets are bonded to an outer peripheral surface of a substantially cylindrically shaped iron core, and a gap between both end portions of each permanent magnet in its circumferential direction and both end portions of an iron core of a stator in its circumferential direction is configured to be wider than a gap between other portions thereof.

According to such a configuration, the rotor of the brushless DC motor is configured with bonding the multiple permanent magnets to the outer peripheral surface of the substantially cylindrically shaped iron core, and the gap between both end portions of each permanent magnet in its circumferential direction and both end portions of the iron core of the stator in its circumferential direction is made wider than the gap between other portions thereof, so that a counter electromotive voltage generated in the winding of the motor becomes the substantially sinusoidal waveform, and thereby, a high efficiency and noise reduction of the brushless DC motor can be achieved in cooperation with the voltage having the sinusoidal waveform applied to the winding of the motor.

Furthermore, it is preferable that a rotor of the brushless DC motor should be configured so that multiple permanent magnets having a substantially arc-shaped cross section are embedded in its circumferential direction.

According to such a configuration, since the rotor of the brushless DC motor is configured that the multiple permanent magnets having the substantially arc-shaped cross section are embedded in its circumferential direction, a counter electromotive voltage generated in the winding of the motor has the substantially sinusoidal waveform similarly as in claim 6 (SIC), so that a high efficiency and noise reduction of the brushless DC motor can be achieved in cooperation with the voltage having the sinusoidal waveform applied to the winding of the motor.

Alternatively, it may be a massage machine that performs treatments by driving treatment heads to trace a three-dimensional trajectory, wherein a brushless DC motor is used as a motor which is switched between a normal rotation and a reverse rotation at least once while treatment heads trace the three-dimensional trajectory among motors for driving the treatment heads; and a control circuit for driving the brushless DC motor corrects a waveform of a drive signal applied to a winding of the brushless DC motor corresponding to a load imposed on the brushless DC motor, so as to allow a current flowing through the winding of the brushless DC motor to have a substantially sinusoidal waveform.

According to such a configuration, since the brushless Dc motor is used as the motor which is switched between the normal rotation and the reverse rotation at least once while treatment heads trace the three-dimensional trajectory among the motors for driving the treatment heads, and the control circuit for driving the brushless DC motor corrects the waveform of the drive signal applied to the winding of the brushless DC motor corresponding to the load imposed on the brushless DC motor, so as to allow the current flowing through the winding of the brushless DC motor to have the substantially sinusoidal waveform, it possible to obtain an effect similar to that described above, regardless of the massage machine configuration.

The present application is based on Japanese Patent Application 2004-299826, the content of which is thereby to be incorporated into the invention of the present application by reference to the specification and drawings of the Patent Application.

The present invention has been described using embodiments with reference to the annexed drawings. However, it may be apparent to those ordinarily skilled in the art that various alterations and modifications are possible. Accordingly, it should be interpreted that such alterations and modifications do not fall outside the scope of the present invention, but fall within the scope of the present invention.

The invention claimed is:

1. A massage machine comprising:

a chair;

a driving unit which itself moves up and down along guide rails provided on a backrest of the chair;

a first motor that moves the driving unit up and down along the guide rails;

a pair of treatment head bases provided in the driving unit and driven reciprocally in opposite directions to each other along widthwise direction of the chair;

a second motor that reciprocally drives the pair of treatment head bases in opposite directions to each other;

treatment heads respectively supported on the pair of treatment head bases, and driven so that a major component of motion is in a plane substantially perpendicular to the backrest of the chair;

a third motor that drives the treatment heads so that the major component of motion becomes substantially perpendicular to the backrest of the chair; and a control circuit that drives the first motor, the second motor and the third motor respectively independently of one another, and wherein at least one of the first motor, the second motor and the third motor is a brushless DC motor having a rotation number detecting circuit, and the control circuit having a rotation speed calculator that counts a time period between signals outputted from the rotation number detecting circuit of the brushless DC motor so as to calculate a rotation speed of the motor, a speed controller that compares a target rotation speed with the rotation speed obtained by calculation and conforms the rotation speed obtained by the calculation with the target rotation speed, and a voltage controller that controls a pulse voltage applied to a winding of the brushless DC motor by pulse width modulation (PWM) control using a target sinusoidal waveform and a triangular waveform having a predetermined carrier frequency which are overlaid on each other so as to define a pulse width as a time period from a first time when both of the target sinusoidal waveform and the triangular waveform intersect to a second time when both of the target sinusoidal waveform and the triangular waveform intersect, thereby allowing the current flowing through the winding of the brushless DC motor to have a substantially sinusoidal waveform.

2. The massage machine in accordance with claim 1, wherein the control circuit comprises a current detector that detects the current flowing through the winding of the brushless DC motor, provides a dead time in the pulse voltage applied to the winding of the brushless DC motor, and reduces the dead time when a value of the current flowing through the winding of the brushless DC motor is small, wherein the dead time is defined as a time period in which no electric current flows in any direction in the winding of the brushless DC motor.

3. The massage machine in accordance with claim 1, wherein the control circuit provides a dead time in the pulse voltage applied to the winding of the brushless DC motor, and varies the dead time corresponding to a pulse width of the pulse voltage applied to the brushless DC motor, wherein the dead time is defined as a time period in which no electric current flows in any direction in the winding of the brushless DC motor.

4. The massage machine in accordance with claim 1, wherein the control circuit comprises a current detector that detects the current flowing through the winding of the brushless DC motor, and reduces the carrier frequency of the triangular waveform when a value of the current flowing through the winding of the brushless DC motor is small.

5. The massage machine in accordance with claim 1, wherein a rotor of the brushless DC motor is configured so that multiple permanent magnets having a substantially arc-shaped cross-section are bonded to an outer peripheral surface of a substantially cylindrically shaped iron core, and both end portions of each of the permanent magnets in a circumferential direction is formed thinner than that of a central portion thereof.

6. The massage machine in accordance with claim 1, wherein a rotor of the brushless DC motor is configured so that multiple permanent magnets having a substantially arc-shaped cross section are embedded in its circumferential direction.

7. The massage machine in accordance with claim 2, wherein a rotor of the brushless DC motor is configured so that multiple permanent magnets having a substantially arc-shaped cross-section are bonded to an outer peripheral surface of a substantially cylindrically shaped iron core, and both end portions of each of the permanent magnets in a circumferential direction is formed thinner than that of a central portion thereof.

8. The massage machine in accordance with claim 3, wherein a rotor of the brushless DC motor is configured so that multiple permanent magnets having a substantially arc-shaped cross-section are bonded to an outer peripheral surface of a substantially cylindrically shaped iron core, and both end portions of each of the permanent magnets in a circumferential direction is formed thinner than that of a central portion thereof.

9. The massage machine in accordance with claim 4, wherein a rotor of the brushless DC motor is configured so that multiple permanent magnets having a substantially arc-shaped cross-section are bonded to an outer peripheral surface of a substantially cylindrically shaped iron core, and both end portions of each of the permanent magnets in a circumferential direction is formed thinner than that of a central portion thereof.

10. The massage machine in accordance with claim 2, wherein a rotor of the brushless DC motor is configured so that multiple permanent magnets having a substantially arc-shaped cross section are embedded in its circumferential direction.

11. The massage machine in accordance with claim 3, wherein a rotor of the brushless DC motor is configured so that multiple permanent magnets having a substantially arc-shaped cross section are embedded in its circumferential direction.

12. The massage machine in accordance with claim 4, wherein a rotor of the brushless DC motor is configured so that multiple permanent magnets having a substantially arc-shaped cross section are embedded in its circumferential direction.

13. A massage machine that performs treatments by driving treatment heads to trace a three-dimensional trajectory, wherein a brushless DC motor is used as a motor which is switched between a normal rotation and a reverse rotation at least once while treatment heads trace the three-dimensional trajectory among motors for driving the treatment heads; and a control circuit having a rotation speed calculator that counts a time period between signals outputted from the rotation number detecting circuit of the brushless DC motor so as to calculate a rotation speed of the motor, a speed controller that compares a target rotation speed with the rotation speed obtained by calculation and conforms the rotation speed obtained by the calculation with the target rotation speed, and a voltage controller that controls a pulse voltage applied to a winding of the brushless DC motor by pulse width modulation (PWM) control using a target sinusoidal waveform and a triangular waveform having a predetermined carrier frequency which are overlaid on each other so as to define a pulse width as a time period from a first time when both of the target sinusoidal waveform and the triangular waveform intersect to a second time when both of the target sinusoidal waveform and the triangular waveform intersect, thereby allowing the current flowing through the winding of the brushless DC motor to have a substantially sinusoidal waveform.

* * * * *